US009964346B2

(12) United States Patent
Hua

(10) Patent No.: US 9,964,346 B2
(45) Date of Patent: May 8, 2018

(54) SPACE CONDITIONING SYSTEM WITH HOT GAS REHEAT, AND METHOD OF OPERATING THE SAME

(75) Inventor: Yi Hua, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 1681 days.

(21) Appl. No.: 13/460,073

(22) Filed: Apr. 30, 2012

(65) Prior Publication Data

US 2013/0283831 A1 Oct. 31, 2013

(51) Int. Cl.

| | |
|---|---|
| ***F25B 41/04*** | (2006.01) |
| ***F25B 49/02*** | (2006.01) |
| ***F24F 3/153*** | (2006.01) |

(52) U.S. Cl.

CPC ..... *F25B 41/04* (2013.01); *F24F 3/153* (2013.01); *F25B 49/02* (2013.01); *F25B 2400/0403* (2013.01)

(58) Field of Classification Search

CPC ..... F24F 3/153; F24F 11/008; F25B 29/00; F25B 29/003; F25B 2400/0403; F25B 2600/2521; F25B 2400/04; F25B 2400/061; F25B 2341/0652; F25B 2700/02; F25B 2313/02343; F25B 2600/2507

See application file for complete search history.

(56) References Cited

U.S. PATENT DOCUMENTS

| | | | | |
|---|---|---|---|---|
| 3,738,117 A * | 6/1973 | Engel | B61D 27/0018 62/173 |
| 5,651,258 A | 7/1997 | Harris | |
| 5,752,389 A * | 5/1998 | Harper | F24F 3/153 62/176.5 |
| 6,644,049 B2 | 11/2003 | Alford | |
| 6,826,921 B1 | 12/2004 | Uselton | |
| 7,228,708 B2 * | 6/2007 | Taras | F24F 3/153 62/196.4 |
| 7,469,555 B2 | 12/2008 | Taras et al. | |
| 7,503,183 B2 * | 3/2009 | Bussjager | F24F 3/153 62/113 |

(Continued)

FOREIGN PATENT DOCUMENTS

| | | |
|---|---|---|
| DE | 2149548 | 4/1972 |
| WO | 2007040476 | 4/2007 |
| WO | 2009151830 | 12/2009 |

OTHER PUBLICATIONS

EP13002277 Extended European Search Report dated Aug. 27, 2013 (5 pages).

*Primary Examiner* — David Teitelbaum
*Assistant Examiner* — Martha Tadesse
(74) *Attorney, Agent, or Firm* — Michael Best & Friedrich LLP

(57) ABSTRACT

A space conditioning system includes a hot gas reheat section and one or more modulating valves to direct a percentage of refrigerant flow to the hot gas reheat section. The hot gas reheat section includes multiple refrigerant circuits arranged in parallel. A control valve is used to allow the refrigerant to flow through selected ones of the multiple refrigerant circuits in response to the percentage of refrigerant flow directed to the hot gas reheat section, thereby varying the internal volume of the hot gas reheat section available to the refrigerant. Refrigerant charge hold-up within the hot gas reheat section can thereby be minimized.

25 Claims, 7 Drawing Sheets

(56) References Cited

U.S. PATENT DOCUMENTS

| | | | | |
|---|---|---|---|---|
| 7,921,661 | B2 | 4/2011 | Taras et al. | |
| 2005/0230080 | A1* | 10/2005 | Paul | F04B 19/006 165/47 |
| 2006/0053823 | A1* | 3/2006 | Taras | F24F 3/153 62/324.1 |
| 2006/0090502 | A1* | 5/2006 | Taras | F24F 3/153 62/510 |
| 2006/0225444 | A1* | 10/2006 | Taras | F24F 3/153 62/173 |
| 2007/0175227 | A1* | 8/2007 | Knight | F24F 3/153 62/176.1 |
| 2007/0283712 | A1* | 12/2007 | Taras | F24F 3/153 62/324.1 |
| 2010/0107668 | A1 | 5/2010 | Voorhis | |

* cited by examiner

SPACE CONDITIONING SYSTEM WITH HOT GAS REHEAT, AND METHOD OF OPERATING THE SAME

BACKGROUND

Space conditioning systems are used to maintain desirable levels of temperature, humidity, and fresh air inside of buildings, vehicles, and the like. Of particular importance in the proper operation of such a system is maintaining proper humidity levels. In addition to imposing discomfort on occupants, high humidity levels can lead to the growth of molds, fungi, and other non-desirable organisms. These concerns lead to the ability of the space conditioning system to remove humidity from the air (referred to as latent heat load) being a major design consideration.

At the same time, concerns over poor indoor air quality caused by inadequate air exchange have led to the desire for higher fresh air ventilation rates. When the outside relative humidity is elevated, such high fresh air ventilation rates coupled with the desire for low internal humidity levels lead to a high latent heat load on the space conditioning system.

The typical method by which large amounts of humidity are removed is to reduce the temperature of the air being supplied to the building to a level at which the saturation pressure of water vapor is substantially below the actual partial pressure of the water vapor in the air. In doing so, the excess water vapor will condense to liquid water, and can be removed from the air. This results in the dew point temperature of the supply air being fixed at about that temperature to which the air has been reduced.

Oftentimes, however, the desirable dew point temperature is lower than the desirable dry-bulb temperature at which the supply air is to be delivered for occupant comfort. In order to meet both the humidity and the temperature requirements, the supply air is often reheated to a desirable dry-bulb temperature after the excess humidity has been removed. Significant energy can be expended by first cooling the supply air to remove the latent head, and then reheating the air to an acceptable temperature. In order to improve the energy efficiency of a space conditioning system, it is desirable to recover some of the latent heat load that is removed for humidity control as the heat source for reheating the air to an acceptable temperature.

SUMMARY OF THE INVENTION

In an embodiment of the invention, a space conditioning system includes a compressor, a condenser, and a hot gas reheat section. One or more modulating valves are coupled to an outlet of the compressor to receive compressed vapor refrigerant from the compressor. An inlet of the condenser is coupled to a first outlet of the one or more modulating valves. The hot gas reheat section includes first and second sets of refrigerant circuits arranged to be fluidly in parallel with one another. Both sets of the refrigerant circuits are connected to a second outlet of the one or more modulating valves via refrigerant flow paths. A control valve is located along the flow path connecting the second set of refrigerant circuits to the modulating valves.

According to some embodiments, the one or more modulating valves selectably direct a first percentage of the refrigerant through the first outlet, and a second percentage of the refrigerant through the second outlet.

In some embodiments, the control valve can be in either an open or a closed state. In some embodiments, the outlets of the first and second sets of refrigerant circuits are connected to the inlet of the condenser.

In another embodiment of the invention, a space conditioning system includes a compressor, a condenser, and a hot gas reheat section. The hot gas reheat section includes first and second sets of refrigerant circuits arranged to be fluidly in parallel with one another. A first refrigerant flow path extends between the compressor and the condenser and passes through the hot gas reheat section. A first branch of the first flow path extends through the first set of refrigerant circuits, and a second branch passes through the second set. A second refrigerant flow path extends between the compressor and the condenser and bypasses the hot gas reheat section.

According to some embodiments, a first means for controlling flow is located along the first and second refrigerant flow path to proportion the flow between those flow paths. A second means for controlling flow is located along the second branch.

In another embodiment of the invention, a method of operating a space conditioning system includes using a compressor to move a refrigerant flow through the system, receiving an input signal, comparing the signal to a setpoint, and adjusting a modulating valve in response in order to change the amount of refrigerant being directed to a hot gas reheat section. The position of the modulating valve is used to determine the preferred available internal volume of the hot gas reheat section, and a control valve is opened or closed in order to allow refrigerant to flow only through a volume of the hot gas reheat section that is equal to the preferred volume.

According to some embodiments, the preferred available volume is selected from a pre-defined set of volumes. In some embodiments, the set of volumes includes a first volume, and a second volume that includes the first volume. In some embodiments, the second volume is approximately twice the size of the first volume.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
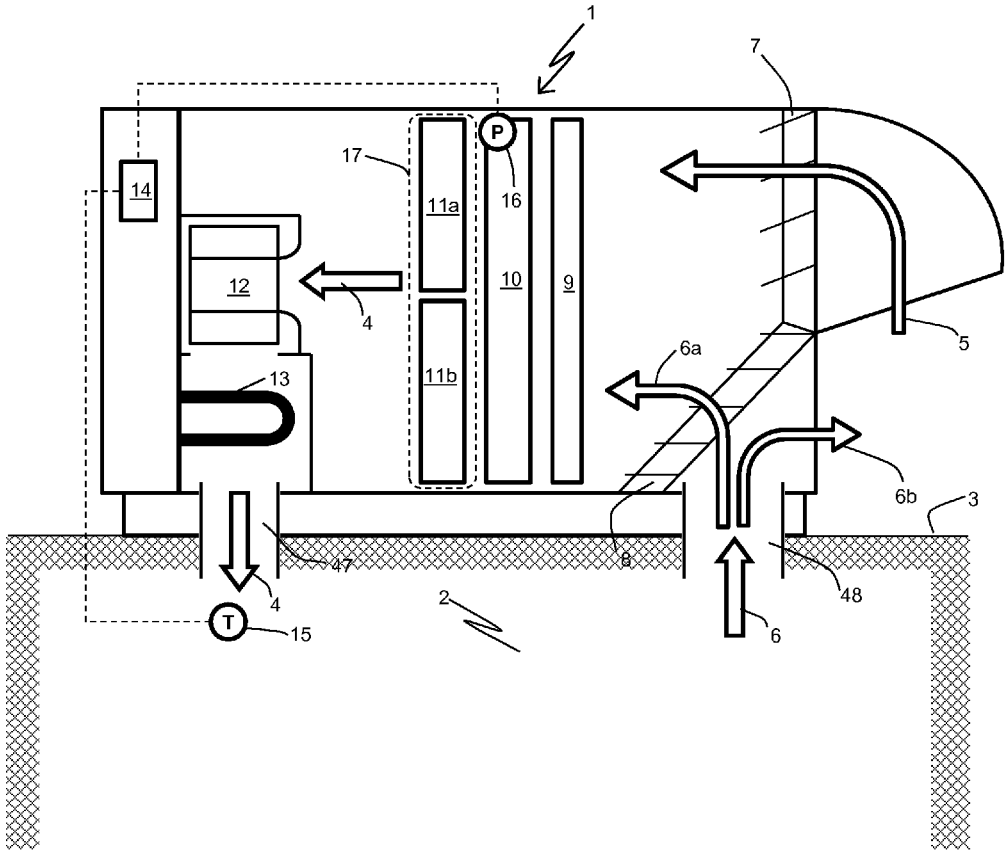
FIG. 1 is a section view, in somewhat schematic form, of a space conditioning system according to an embodiment of the invention.

Certain aspects of a space conditioning system 1 according to an embodiment of the invention are shown in diagrammatic fashion in FIG. 1. The space conditioning system 1 is located on top of the roof 3 of a building 2 in order to condition one or more spaces located within the building 2. Conditioned supply air 4 is delivered to the building 2 through a supply duct 47 extending through the roof 3 and into the space conditioning system 1. Return air 6 is received from the building 2 through a return air duct 48 similarly extending through the roof 3 and into the space conditioning system 1.

A portion 6*a* of the return air may be recycled and mixed with a flow of fresh make-up air 5 to produce the supply air 4. The remaining portion 6*b* of the return air is rejected back to the ambient environment. The balance between fresh make-up air 5 and recirculated air 6*a* is controlled by adjusting the position of a set of fresh air dampers 7, and a set of recirculated air dampers 8. Under some operating conditions, the fresh make-up air dampers 7 may be completely closed so that the supply air 4 consists entirely of recirculated air 6*a*. In other operating conditions the recirculated air dampers 8 may be completely closed so that the supply air 4 consists entirely of fresh air 5.

Located within the space conditioning system 1 along the path of the supply air 4 are a filter 9, an evaporator coil 10, and a hot gas reheat section 17. The filter 9 removes larger particulates such as smoke, dust, insects, etc., that may be entrained within the air flow. The evaporator 10 cools the supply air 4 down to a low dew point temperature, thereby condensing and removing excess humidity from the air. After passing through the evaporator coil 10, the supply air 4 passes through a hot gas reheat section 17, where the supply air may be reheated to a desirable dry-bulb temperature.

The flow of the supply air through the dampers 7 and 8, the filter 9, the evaporator coil 10 and the hot gas reheat section 17 is accomplished by way of a blower 12. The blower 12 draws the air through the aforementioned components of the space conditioning system 1, and subsequently directs the supply air 4 into the building 2 through the supply air duct 47. An auxiliary heater 13 may optionally be included to provide for additional heating of the supply air 4, as may be desirable during cold weather. The auxiliary heater 13 may be, for example, a gas-fired heater or an electric heater.

The exemplary embodiment of FIG. 1 further includes a temperature sensor 15 located within the supply air duct 47 to measure the temperature of the supply air 4 entering the building 2, and a suction line pressure sensor 16 to measure a suction-side refrigerant pressure. The sensor 15 may be located on either side of the roof 3, and may optionally be located within the enclosure of the space conditioning system 1. Both the temperature sensor 15 and the suction line pressure sensor 16 are in communication with a controller 14, as indicated by the dashed lines.

Turning now to the schematic diagram of FIG. 2, the refrigerant circuit within the space conditioning system 1 will be explained in more detail. The refrigerant circuit includes the evaporator coil 10, the hot gas reheat section 17, a condenser 20, a compressor 18, and an expansion valve 19. It should be understood that, although reference is made to each of these components in the singular, in some cases multiple such components may be included within a space conditioning system 1. For example, the compressor 18 may include several compressors arranged in tandem. Similarly, the evaporator coil 10 may include multiple discrete coils, each of which may have its own expansion valve 19.

As refrigerant passes through the condenser 20, it is cooled and condensed to a sub-cooled liquid state by air that is directed over tube surfaces of the condenser by the fans 21. The sub-cooled liquid refrigerant is expanded to a low-pressure state in the expansion valve 19, and passes through the evaporator coil 10. As the refrigerant passes through the evaporator coil 10, it receives sensible and/or latent heat from the supply air 4, causing the refrigerant to vaporize and exit the evaporator coil 10 as a superheated vapor. The suction line pressure sensor 16 measures the pressure of the refrigerant at the low-pressure side of the refrigerant circuit (i.e. between the expansion valve 19 and the compressor 18).

The superheated vapor refrigerant is compressed to an elevated pressure by the compressor 18, and is subsequently directed to a modulating valve device 22. The modulating valve device 22 includes an inlet 25 that is operatively coupled to the compressor 18, in order to receive the compressed vapor refrigerant therefrom. The modulating valve device 22 further includes a first outlet 26 and a second outlet 27. The outlet 26 is operatively coupled to the inlet of the condenser 20. The outlet 27 is operatively coupled to the hot gas reheat section 17.

During operation of the space conditioning system 1, the modulating valve device 22 can be used to selectively direct a first percentage of the compressed vapor refrigerant through the outlet 26, and a second percentage of the refrigerant through the outlet 27. In doing so, the first percentage of the compressed vapor refrigerant effectively bypasses the hot gas reheat section 17.

The hot gas reheat section 17 includes two or more refrigerant circuits 11. In the exemplary embodiment of FIG. 2, two circuits (11*a* and 11*b*) are depicted, although it should be understood that other embodiments might include additional refrigerant circuits 11. A refrigerant flow path 28 fluidly connects the outlet 27 of the modulating valve device 22 to an inlet of the refrigerant circuit 11*a*, while a refrigerant flow path 29 fluidly connects the outlet 27 of the modulating valve device 22 to an inlet of the refrigerant circuit 11*b*. The refrigerant flow paths 27 and 28 may be coincident for a portion of their lengths, before branching off separately.

A control valve 23 is located along the refrigerant flow path 29, but is not located along the refrigerant flow path 28. During operation of the space conditioning system 1, the control valve 23 can be in either an open state (thereby allowing for the flow of refrigerant to the refrigerant circuit 11*b*), or a closed state (thereby preventing the flow of refrigerant to the refrigerant circuit 11*b*). The control valve 23 may be of any suitable valve type. By way of example only, the control valve may be a gate valve, a globe valve, a plug valve, a butterfly valve, or it may be of some other valve type.

The outlets of the refrigerant circuits 11 of the hot gas reheat section 17 are operatively coupled to the inlet of the condenser 20 so that refrigerant passing through the hot gas reheat section 17 can be recombined with the refrigerant that is bypassing the hot gas reheat section 17 through the outlet 26. Check valves 24 are arranged to prevent the flow of refrigerant back into the refrigerant circuits 11.

Various types of valves or valve combinations known in the art can be used as the modulating valve device 22. For example, in some embodiments the modulating valve device 22 can include a valve member disposed within a single valve body, wherein the placement of the valve member within the valve body throttles the refrigerant flow in varying proportion to the two outlets 26, 27. The placement of the valve member can be varied through an electronic control signal (by way of a step motor, for example) in order to adjust the proportioning of the flow.

Figure 3:
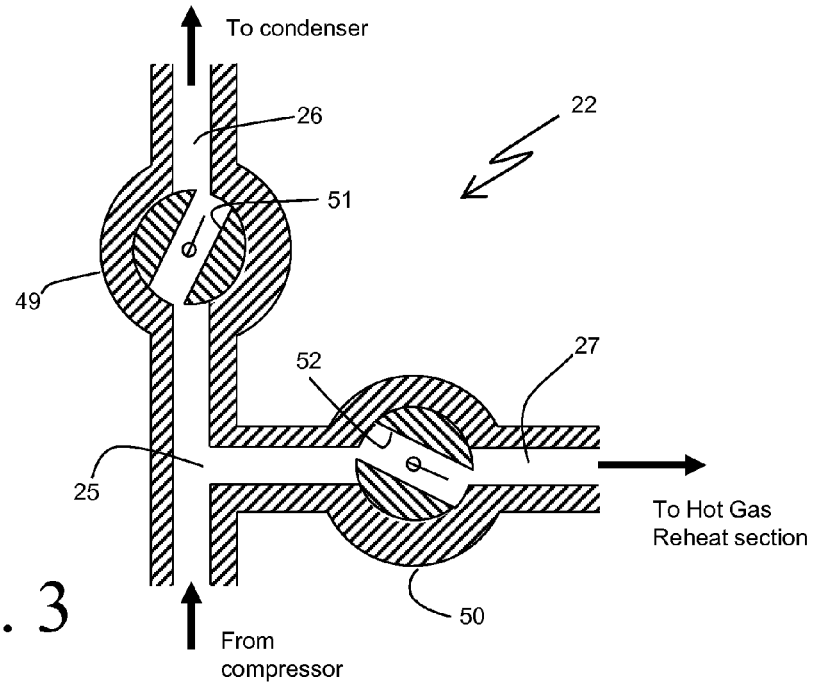
FIG. 3 is a section view of a modulating valve device capable of being used in certain embodiments of the present invention.

In some embodiments the modulating valve device 22 can include two separate valves, both of which are controlled to act in coordination with one another. One embodiment of such a modulating valve device 22 (shown in FIG. 3) includes a first ball valve 49 and a second ball valve 50. The ball valves 49, 50 are both connected to a common point in the refrigerant line extending from the outlet of the compressor, so that the common point functions as the inlet 25 of the modulating valve device 22. A rotatable ball valve disk 51 rotates within the ball valve 49 in order to throttle the flow of refrigerant from the compressor to the condenser. Similarly, a rotatable ball valve disk 52 rotates within the ball valve 50 in order to throttle the flow of refrigerant from the compressor to the hot gas reheat section. By rotating the ball valve disks 51, 52 in coordination, the flow of refrigerant from the compressor can be split into a first percentage passing through the ball valve 49 and bypassing the hot gas reheat section, and a second percentage passing through the ball valve 50 to the hot gas reheat section.

Other types of modulating valves may be used in place of the ball valves 49, 50. For example, globe valves, plug valves, diaphragm valves, butterfly valves, needle valves, or other types of modulating valves can be used in place of one or both ball valves.

Figure 4:
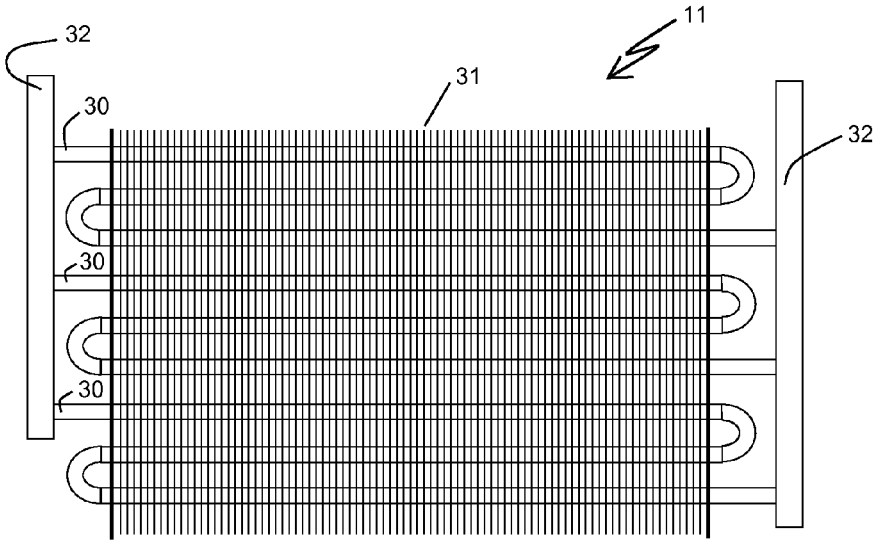
FIG. 4 is a plan view of a heat exchanger capable of being used in certain embodiments of the present invention.

Each of the refrigerant circuits 11 within the hot gas reheat section 17 may take the form of a tube and fin heat exchange coil. In the embodiment of a refrigerant circuit 11 shown in FIG. 4, a plurality of individual refrigerant tubes 30 extend between manifolds 32. The refrigerant tubes 30 extend through a series of air fins 31, so that heat can be transferred to supply air 4 passing over the tubes 30 and fins 31 from the refrigerant flowing inside of the tubes 30. It should be understood by those having skill in the art that, while three parallel arranged tubes 30 are depicted in the exemplary embodiment, more or fewer tubes 30 might be desirable in certain applications. Similarly, while each of the tubes 30 makes three consecutive passes through the air fins 31 in the exemplary embodiment, more or fewer passes might be desirable in certain applications. In some embodiments the air fins 31 may be common to multiple refrigerant circuits 11. In some such embodiments the multiple refrigerant circuits 11 may be embodied in a single heat exchange core with separate circuits 11, each of which has its own manifolds 32.

Figure 5:
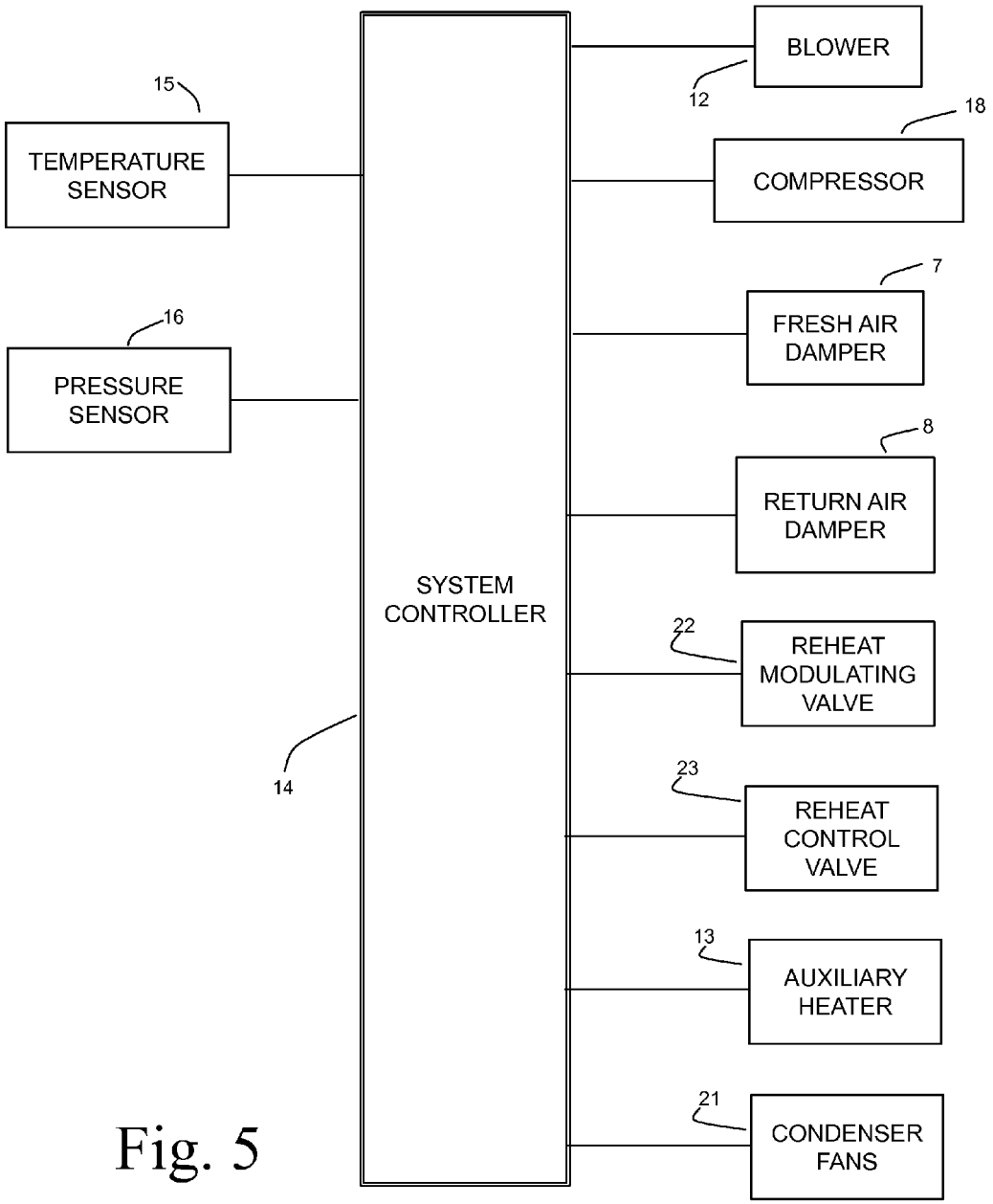
FIG. 5 is a block diagram showing certain portions of a control system for the embodiment of FIG. 1.

With reference to FIG. 5, the system controller 14 is configured to receive electronic signals from the temperature sensor 15 and suction line pressure sensor 16. In response to the receipt of such signals, as well as to other optional inputs including but not limited to additional sensors and operator inputs, the system controller 14 may turn on, turn off, modulate or adjust one or more of the controllable components of the space conditioning system 1. It should be understood that the system controller 14 may be a single device, or it may be two or more discrete devices. It should further be understood that various types of devices can be used as the system controller 14, including but not limited to computers, integrated circuits, programmable logic controllers, etc.

The blower 12, return air damper 8 and fresh air damper 7 may be controlled by the system controller 14 to provide a desired amount of ventilation supply air 4, with a desired split between fresh air 5 and recycled air 6. The compressor 18 and condenser fans 21 may be controlled by the system controller 14 to provide cooling and/or dehumidification of the supply air when either the temperature of the supply air 4 (as measured by the temperature sensor 15) or the humidity of the supply air 4 is in excess of a desired value. The humidity of the supply air may be inferred by the controller 14 from the pressure measured by the suction line pressure sensor 16, as that pressure will correlate to a known refrigerant saturation temperature, and the dew-point of the supply air 4 will be reduced to approximately that temperature by passing through the evaporator 10. The auxiliary heater 13 may be controlled by the system controller 14 during heating mode, when the temperature of the supply air 4 (as measured by the temperature sensor 15) is below a desired value. The reheat modulating valve device 22 and the reheat control valve 23 may also be controlled by the system controller 14, as will be described with specific reference to FIGS. 6-8.

Figure 6:
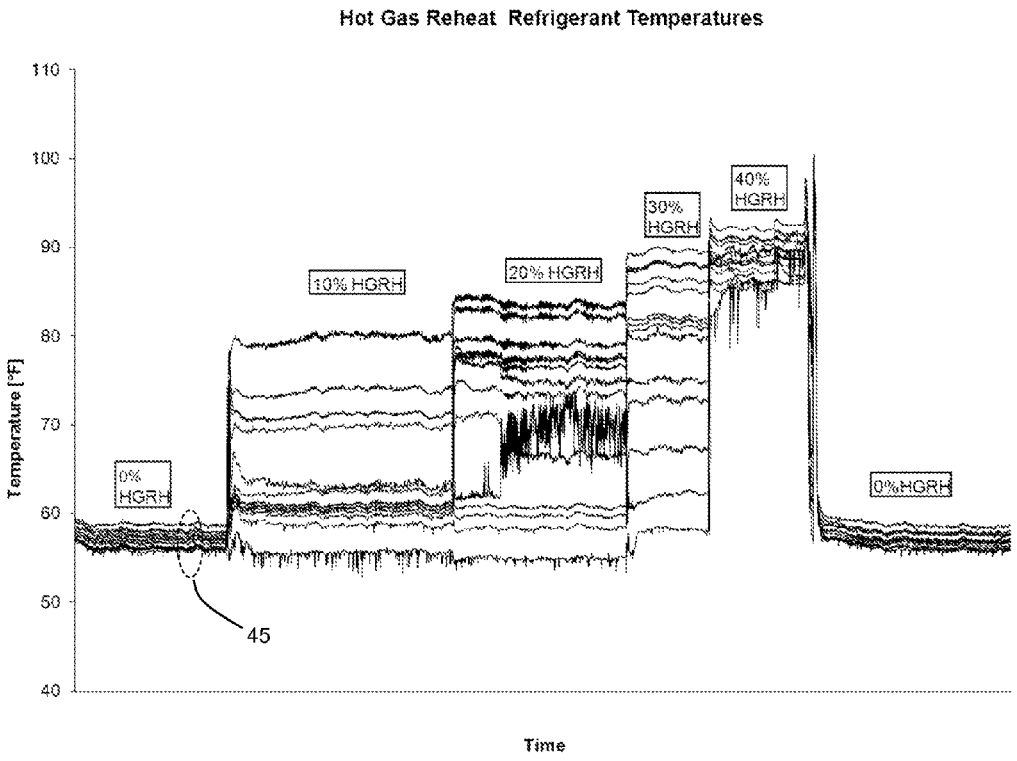
FIG. 6 is a graph of test data collected from a space conditioning system operating without benefit of the invention.

The graph of FIG. 6 shows data obtained through testing of a space conditioning system operating without the benefit of the present invention. Specifically, the system used to produce the graph of FIG. 6 has a hot gas reheat section consisting of a single refrigerant circuit. A modulating valve device as previously described was present in the system, and was controlled to deliver a varying percentage of the refrigerant flow exiting the compressor to the hot gas reheat section, with the balance of the refrigerant flow bypassing the hot gas reheat section and passing directly to the condenser.

The temperature traces 45 indicate the measured temperatures at the outlets of each of the fifteen refrigerant tubes within the hot gas reheat refrigerant circuit. The system was operated over a period of time, with only the percentage of refrigerant flow directed to the hot gas reheat section (indicated on the graph as "% HGRH") being varied over that time period.

When the system was operated with 0% hot gas reheat, all of the temperature traces 45 are in a temperature range of 55° F.-58° F. This temperature would essentially correspond to the temperature of the supply air leaving the evaporator, since there is no refrigerant flowing through the hot gas reheat circuit to transfer heat from or to the air.

Once refrigerant is directed through the hot gas reheat section, many of the temperature traces 45 increase in temperature. The refrigerant flowing through those circuits is rejecting heat to the supply air passing through the hot gas reheat section, causing the refrigerant to cool and condense to a liquid refrigerant. However, several of the temperature traces 45 remain at or near the supply air temperature, indicating that the refrigerant in those tubes is fully liquefied and is stagnant. These tubes tend to be the lowermost tubes in the hot gas reheat section, as gravity effects will cause the higher-density liquid to migrate towards the bottom tubes.

This accumulation of liquid refrigerant within the hot gas reheat section can have non-desirable impacts on the operation of the space conditioning system. The high density of the liquid refrigerant (in comparison to the density of vapor refrigerant) can lead to a substantially large amount of refrigerant mass being trapped within the hot gas reheat section during operation with low levels of hot gas reheat. This leads to the system being effectively undercharged of refrigerant, a condition that can cause multiple problems including: the evaporator being starved of refrigerant, high compressor outlet temperatures, decreased system capacity, and more.

While it may be possible to counteract the aforementioned problems by increasing the refrigerant charge, such a solution will cause other problems when the system is operated with high levels of hot gas reheat. During such operation, the system would be effectively overcharged of refrigerant, which can lead to (among other things) increased compressor work, increased condenser pressure, and increased subcooling.

As the amount of refrigerant being diverted to the hot gas reheat section continues to be increased, eventually sufficient refrigerant is flowing through the hot gas reheat section to prevent the condensation and accumulation of liquid refrigerant. In the graph of FIG. 6, this can be observed at 40% hot gas reheat. At this operating condition, all of the tubes have elevated exit temperatures of 85° F.-95° F.

Figure 2:
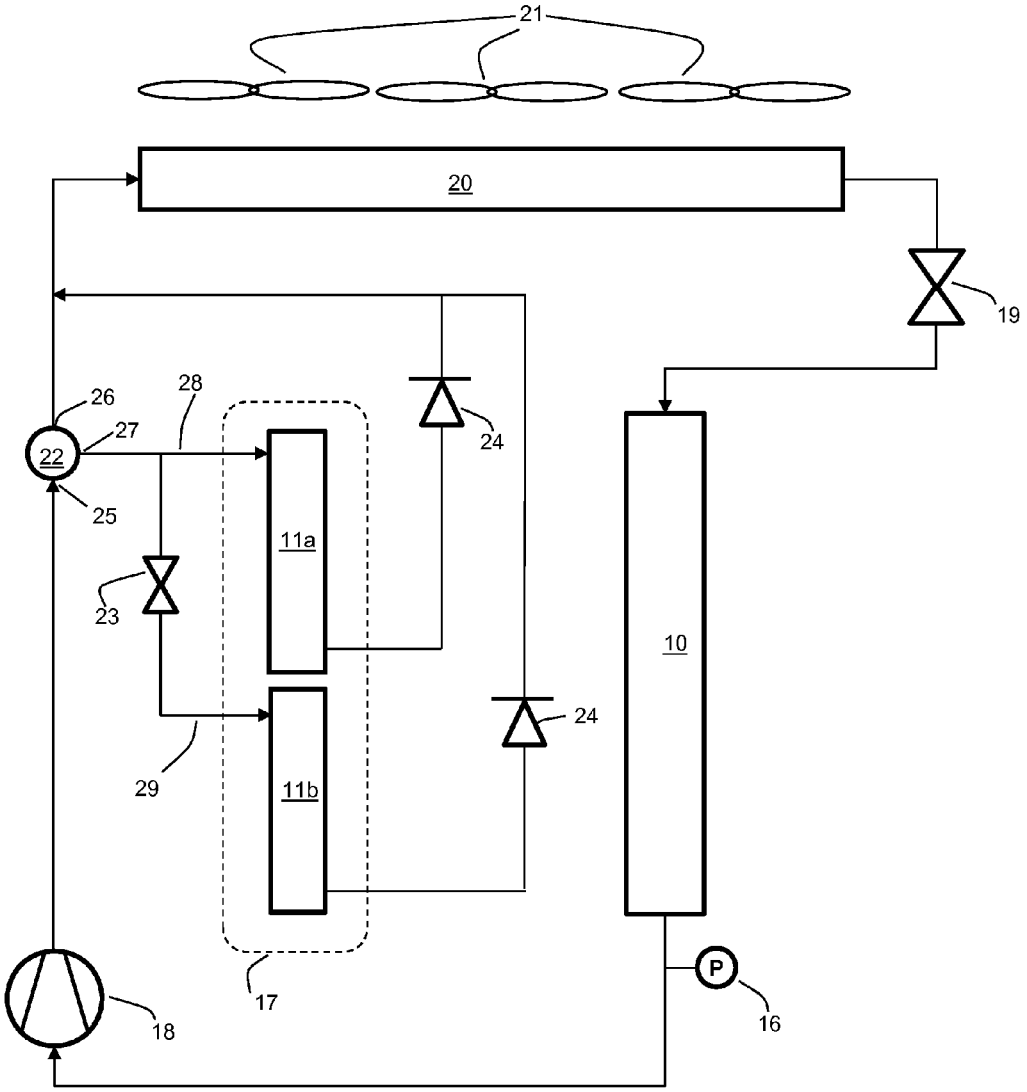
FIG. 2 is a schematic view of a refrigerant loop of the embodiment of FIG. 1.
Figure 7:
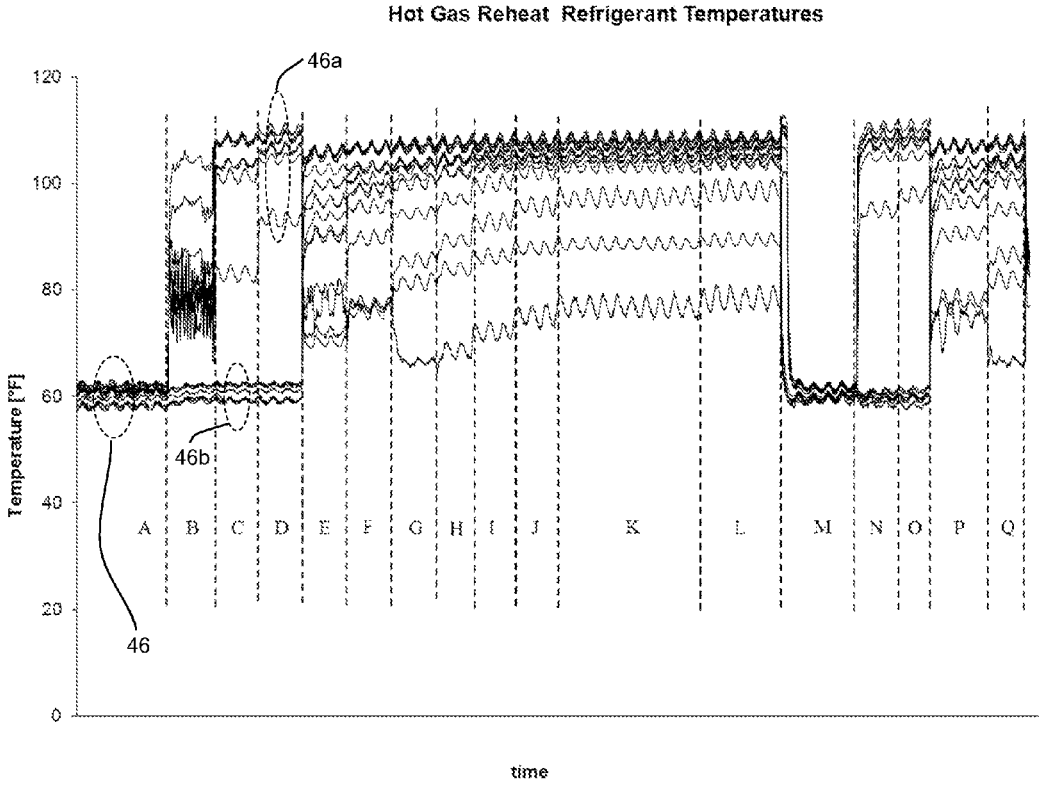
FIG. 7 is a graph of test data collected from a space conditioning system operating in accordance with an embodiment of the present invention.

FIG. 7 depicts a similar graph, but in this case the space conditioning system under test is according to the embodiment of FIGS. 1 and 2. The hot gas reheat section of the system of FIG. 7 includes two refrigerant circuits, each of which contains seven refrigerant tubes. The temperature traces 46 illustrate the temperatures at the outlets of each tube, with the traces 46*a* indicating the temperatures for the circuit corresponding to 11*a* in FIGS. 1 and 2, and the traces 46*b* indicating the temperatures for the circuit corresponding to 11*b*.

The different operating cases depicted in the graph are labeled with the letters "A" through "Q", and correspond to the conditions listed in the following table:

| Case | % HGRH | Control Valve Status |
|---|---|---|
| A | 0% | closed |
| B | 10% | closed |
| C | 20% | closed |
| D | 30% | closed |
| E | 30% | open |
| F | 40% | open |
| G | 50% | open |
| H | 60% | open |
| I | 70% | open |
| J | 80% | open |
| K | 90% | open |
| L | 100% | open |
| M | 0% | closed |
| N | 30% | closed |
| O | 40% | closed |
| P | 40% | open |
| Q | 50% | open |

In the first three cases with refrigerant flowing to the hot gas reheat section (cases B-D) the control valve 23 is in a closed state. As a result, no refrigerant is flowing through the refrigerant circuit 11*b*, and the temperature traces 46*b* corresponding to the outlets of the tubes in that circuit are held to the temperature of the supply air exiting the evaporator (approximately 60° F.). Relatively little refrigerant charge is contained within those tubes, though, since the check valve 24 prevents the back-flow of refrigerant into the circuit 11*b*.

Because the volume available to the refrigerant passing through the hot gas reheat section is limited to the internal volume of the tubes in the refrigerant circuit 11*a* only, the amount of heat that can be transferred from the refrigerant to the supply air is limited. Although the refrigerant exits those tubes as a condensed liquid (for reference, the saturation temperature of the refrigerant passing through the hot gas reheat section in the testing was approximately 120° F.), the elevated temperatures (46*a*) relative to the temperature of the supply air exiting the evaporator indicate that only the exit portions of those tubes are flooded with liquid refrigerant. The majority of the internal volume of those tubes will contain vapor phase refrigerant, and this vapor phase refrigerant will tend to push the condensed liquid refrigerant through the tubes, thereby preventing the collection of liquid charge in the hot gas reheat circuit.

In cases E-L the control valve 23 is in an open state and the total volume available to the refrigerant in the hot gas reheat section 17 is the sum of the internal volumes of the circuits 11*a* and 11*b*. In both cases D and E, the refrigerant flow split is at 30% hot gas reheat flow. One the control valve 23 is opened and refrigerant is allowed to pass into the refrigerant circuit 11*b*, the measured temperatures 46*b* increase from the values of approximately 60° F. observed in case D. The temperatures 46*b* seen in case E are grouped substantially below the temperatures 46*a*, indicating that a greater portion of the tube volume in the circuit 11*b*, as compared to the tube volume in the circuit 11*a*, is occupied by liquid refrigerant.

Figure 8:
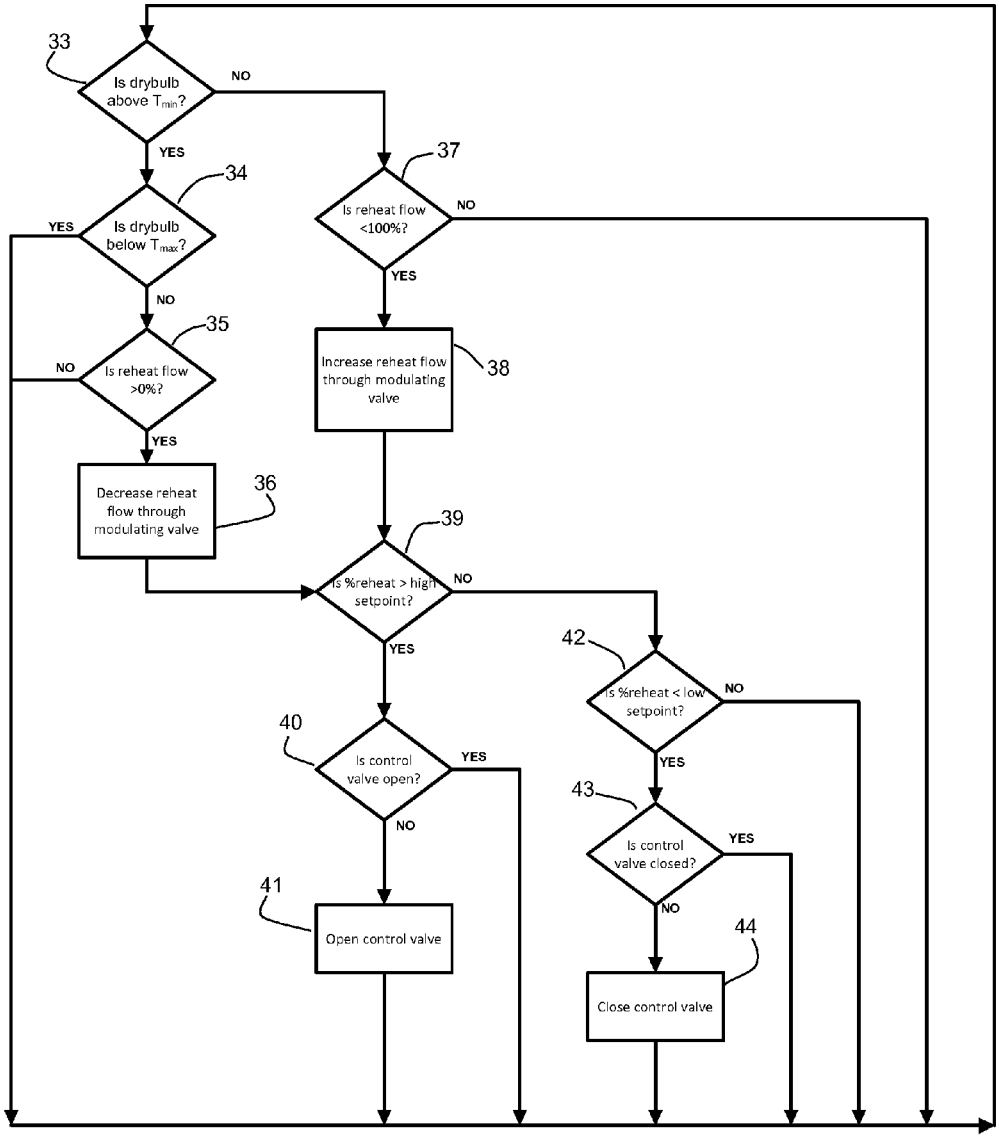
FIG. 8 is a flow diagram depicting portions of the operation of a space conditioning system according to an embodiment of the present invention.

In order to minimize the effective charge reduction through accumulation of liquid refrigerant charge in the hot gas reheat section 17, a space conditioning system 1 may be controlled by the system controller 14 in the manner illustrated in the control diagram of FIG. 8. When the space conditioning system 1 is operating in an air conditioning mode (i.e. the compressor 18 is directing refrigerant through the refrigerant circuit), the controller 14 receives a signal from the temperature sensor 15 and determines, in step 33, whether or not the temperature measured by the sensor 15 is above the programmed minimum dry-bulb temperature, $T_{min}$. If it is, the controller next determines (step 34) if the temperature measured by the sensor 15 is below the programmed maximum dry-bulb temperature, $T_{max}$. If the measured temperature is both greater than $T_{min}$ and less than $T_{max}$, the thermostat is considered to be satisfied, and no action is taken until the next time iteration when step 33 is again performed.

In the case where the temperature measured by the sensor 15 is not above $T_{min}$, the control system next proceeds to step 37. The controller 14 evaluates whether or not the modulating valve device 22 is currently diverting all of the refrigerant flow through the hot gas reheat section 17. If that percentage of the refrigerant flow is less than 100%, the controller proceeds to step 38 and incrementally adjusts the modulating valve device 22 in order to direct a greater percentage of the refrigerant flow through the hot gas reheat section 17.

If, on the other hand, the temperature measured by the sensor 15 is both above $T_{min}$ and above $T_{max}$, then the controller 14 determines (step 35) whether or not any flow is being directed to the hot gas reheat section 17 by the modulating valve device 22. If flow is being so directed, the controller 14 proceeds to step 36 and incrementally adjusts the modulating valve device 22 in order to direct a lesser percentage of the refrigerant flow through the hot gas reheat section 17.

After either of steps 36 and 38 is performed, the controller 14 next compares the percent reheat flow to a pre-programmed high setpoint (step 39). The high setpoint may be a user-programmable variable, or it may be not user-programmable. In some preferable embodiments the high setpoint may be in the range of 30%-50%. If the percent reheat flow exceeds the high setpoint, the controller 14 determines (step 40) if the control valve 23 is open. If it is not, the controller 14 proceeds to step 41 and opens the control valve 23.

If the controller 14 finds, in step 39, that the percent reheat flow is not greater than the high setpoint, then the controller 14 next compares the percent reheat flow to a pre-programmed low setpoint (step 42). The low setpoint also may be, or may not be, a user-programmable variable. In some preferable embodiments the low setpoint may be in the range of 30%-50%. The low setpoint may be equal to the high setpoint, but in preferable embodiments the low setpoint is lower than the high setpoint to provide some hysteresis. For example, in some embodiments the low setpoint is 35% while the high setpoint is 45%. If the percent reheat flow is found to be less than the low setpoint in step 42, the controller 14 determines (step 43) if the control valve 23 is closed. If it is not, the controller 14 proceeds to step 44 and closes the control valve 23.

The control loop of FIG. 8 may be repeated by the controller 14 in repeating fashion at predetermined time interval rates. The control loop might be used in conjunction with an overall control strategy including one or more of proportional, proportional-integral, and proportional-integral-derivative control schemes.

The computation of the percentage flow split between the refrigerant flow directed through port 27 to the hot gas reheat section and the refrigerant flow directed through port 26 bypassing the hot gas reheat section can be computed in various ways. In some embodiments, the flow percentages may be correlated to the positioning of the valve disks 51, 52. Such correlation may be of a non-linear type intended to accurately capture the nonlinear relationship between valve open position and pressure drop through the valve, or it may be a simplified linear relationship.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

I claim:

1. A refrigerant system comprising:

a compressor;

one or more modulating valves operatively coupled to an output of the compressor to receive compressed vapor refrigerant therefrom;

a condenser having an inlet operatively coupled to a first outlet of the one or more modulating valves;

a hot gas reheat section comprising a first plurality of refrigerant circuits and a second plurality of refrigerant circuits fluidly in parallel to the first plurality of refrigerant circuits;

a first refrigerant flow path extending between and operatively coupling a second outlet of the one or more modulating valves and an inlet of the first plurality of refrigerant circuits;

a second refrigerant flow path extending between and operatively coupling the second outlet of the one or more modulating valves and an inlet of the second plurality of refrigerant circuits; and a control valve arranged along the second refrigerant flow path, wherein the control valve is not along the first refrigerant flow path.

2. The refrigerant system of claim 1, wherein the control valve is in one of an open and a closed state.

3. The refrigerant system of claim 1, wherein the one or more modulating valves are operable to selectably direct a first percentage of the compressed vapor refrigerant from the compressor through the first outlet, and a second percentage of the compressed vapor refrigerant from the compressor through the second outlet.

4. The refrigerant system of claim 3, wherein the first percentage can be varied within the range of 0% to 100%.

5. The refrigerant system of claim 3, wherein the sum of the first and second percentages is equal to 100%.

6. The refrigerant system of claim 3, wherein the control valve is in one of an open and a closed state.

7. The refrigerant system of claim 6, wherein the state of the control valve is selected in response to at least one of the first and second percentages.

8. The refrigerant system of claim 1, wherein the outlet of the first and second plurality of refrigerant circuits are operatively coupled to the inlet of the condenser.

9. A refrigerant system comprising:

a compressor;

a condenser;

a hot gas reheat section comprising a first plurality of refrigerant circuits and a second plurality of refrigerant circuits fluidly in parallel to the first plurality of refrigerant circuits;

a first refrigerant flow path extending between an output of the compressor and an inlet of the condenser, the first refrigerant flow path passing through the hot gas reheat section and comprising a first branch extending through the first plurality of refrigerant circuits and a second branch extending through the second plurality of refrigerant circuits;

a second refrigerant flow path extending between an output of the compressor and an inlet of the condenser, the second refrigerant flow path bypassing the hot gas reheat section;

a first flow control means located along the first and second refrigerant flow paths to proportion the refrigerant flow between the first and second refrigerant flow paths; and a second flow control means located along the second branch of the first refrigerant flow path.

10. The refrigerant system of claim 9, wherein the second flow control means is responsive to a control signal to either allow or prevent flow through the second branch of the first refrigerant flow path.

11. The refrigerant system of claim 9, wherein the first flow control means is responsive to a control signal to direct a first percentage of a compressed vapor refrigerant flow from the compressor along the first refrigerant flow path, and a second percentage of a compressed vapor refrigerant flow from the compressor along the second refrigerant flow path.

12. The refrigerant system of claim 11, wherein the first percentage can be varied within the range of 0% to 100%.

13. The refrigerant system of claim 11, wherein the sum of the first and second percentages is equal to 100%.

14. A method of operating a refrigerant system, comprising:

moving a refrigerant flow through the refrigerant system using one or more compressors;

receiving an input signal from a sensor;

comparing the input signal to a command setpoint to determine a deviation from said setpoint;

adjusting the position of a modulating valve member to effect a change in the amount of the refrigerant flow being directed to a hot gas reheat section of the refrigerant system in response to said deviation, said amount defining a hot gas reheat portion of the refrigerant flow;

comparing said position to at least one pre-defined value to determine a preferred available internal volume of the hot gas reheat section, the preferred available internal volume being selected from a pre-defined plurality of internal volumes; and commanding the state of at least one control valve to be in one of an open and a closed state in order to direct the hot gas reheat portion of the refrigerant flow through only those parts of the hot gas reheat section that correspond to the preferred available internal volume.

15. The method of claim 14, wherein the pre-defined plurality of internal volumes includes a first internal volume and a second internal volume, and wherein the second internal volume comprises the first internal volume.

16. The method of claim 15, wherein the second internal volume is approximately twice the size of the first internal volume.

17. The method of claim 15, wherein the preferred available internal volume is the second internal volume when the position of the modulating valve member corresponds to the hot gas reheat portion of the refrigerant flow being greater than 50% of the refrigerant flow.

18. The method of claim 15, wherein the preferred available internal volume is the second internal volume when the position of the modulating valve member corresponds to the hot gas reheat portion of the refrigerant flow being greater than 45% of the refrigerant flow.

19. The method of claim 15, wherein the preferred available internal volume is the first internal volume when the position of the modulating valve member corresponds to the hot gas reheat portion of the refrigerant flow being less than 30% of the refrigerant flow.

20. The method of claim 15, wherein the preferred available internal volume is the first internal volume when the position of the modulating valve member corresponds to the hot gas reheat portion of the refrigerant flow being less than 35% of the refrigerant flow.

21. The method of claim 14, wherein the modulating valve member is a first modulating valve member, further comprising adjusting the position of a second modulating valve member to effect a change in the amount of the refrigerant flow bypassing the hot gas reheat section.

22. The method of claim 14, wherein comparing the position of the modulating valve member to at least one pre-defined value includes comparing said position to a pre-defined high value and comparing said position to a pre-defined low value.

23. The method of claim 22, wherein the pre-defined plurality of internal volumes includes a first internal volume and a second internal volume, and wherein the second internal volume comprises the first internal volume.

24. The method of claim 23, wherein the second internal volume is approximately twice the size of the first internal volume.

25. The method of claim 23, wherein the preferred available internal volume corresponds to the first internal volume when the position of the modulating valve member is less than the pre-defined low value and corresponds to the second internal volume when the position of the modulating valve member is greater than the pre-defined high value.

* * * * *